US010818304B2

(12) United States Patent
Disch et al.

(10) Patent No.: US 10,818,304 B2
(45) Date of Patent: Oct. 27, 2020

(54) PHASE COHERENCE CONTROL FOR HARMONIC SIGNALS IN PERCEPTUAL AUDIO CODECS

(71) Applicant: Fraunhofer-Gesellschaft zur Foerderung der Angewandten Forschung e.V., Munich (DE)

(72) Inventors: Sascha Disch, Fuerth (DE); Juergen Herre, Buckenhof (DE); Bernd Edler, Fuerth (DE); Frederik Nagel, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 14/470,551

(22) Filed: Aug. 27, 2014

(65) Prior Publication Data

US 2014/0372131 A1 Dec. 18, 2014

Related U.S. Application Data

(63) Continuation of application No. PCT/EP2013/053831, filed on Feb. 26, 2013.
(Continued)

(30) Foreign Application Priority Data

Jul. 27, 2012 (EP) ..... 12178265

(51) Int. Cl.
*G10L 19/00* (2013.01)
*G10L 21/00* (2013.01)
(Continued)

(52) U.S. Cl.
CPC ..... *G10L 19/02* (2013.01); *G10L 19/26* (2013.01); *G10L 19/0204* (2013.01)

(58) Field of Classification Search
CPC ..... G10L 21/038; G10L 19/008; G10L 19/02; G10L 19/00; G10L 19/0204;
(Continued)

(56) References Cited

U.S. PATENT DOCUMENTS 5,054,072 A 10/1991 McAulay et al.
6,549,884 B1 * 4/2003 Laroche ..... G10L 19/26 704/203
(Continued)

FOREIGN PATENT DOCUMENTS

CN 1501350 A 6/2004
CN 1898722 A 1/2007
(Continued)

OTHER PUBLICATIONS

J. Laroche and M. Dolson, "Improved phase vocoder time-scale modification of audio," in IEEE Transactions on Speech and Audio Processing, vol. 7, No. 3, pp. 323-332, May 1999.*
(Continued)

*Primary Examiner* — Michael Ortiz-Sanchez
(74) *Attorney, Agent, or Firm* — Perkins Coie LLP; Michael A. Glenn

(57) ABSTRACT

A decoder for decoding an encoded audio signal to obtain a phase-adjusted audio signal is provided. The decoder has a decoding unit and a phase adjustment unit. The decoding unit is adapted to decode the encoded audio signal to obtain a decoded audio signal. The phase adjustment unit is adapted to adjust the decoded audio signal to obtain the phase-adjusted audio signal. The phase adjustment unit is configured to receive control information depending on a vertical phase coherence of the encoded audio signal. Moreover, the phase adjustment unit is adapted to adjust the decoded audio signal based on the control information.

23 Claims, 9 Drawing Sheets

Related U.S. Application Data

(60) Provisional application No. 61/603,773, filed on Feb. 27, 2012.

(51) Int. Cl.
*G10L 19/02* (2013.01)
*G10L 19/26* (2013.01)

(58) Field of Classification Search
CPC . G10L 19/173; G10L 19/0208; G10L 19/087; G10L 19/12; G10L 19/167; G10L 25/18; G10L 25/21; G10L 19/0212; G10L 19/16; G10L 19/025; G10L 19/18; G10L 19/22; G10L 19/26; G10L 21/01; H04L 1/0009; H04L 1/0019; H04L 27/3405; H04L 27/36; H04L 1/0047; H04L 2027/0067; H04H 20/89; H04S 2420/03
See application file for complete search history.

(56) References Cited

U.S. PATENT DOCUMENTS

| | | | | |
|---|---|---|---|---|
| 6,766,300 | B1 * | 7/2004 | Laroche | G10H 1/40 704/211 |
| 7,006,636 | B2 * | 2/2006 | Baumgarte | G10L 19/008 381/1 |
| 7,546,237 | B2 * | 6/2009 | Nongpiur | G10L 21/0364 704/209 |
| 2001/0017897 | A1 * | 8/2001 | Ahn | H04L 27/0014 375/261 |
| 2003/0187663 | A1 | 10/2003 | Truman et al. | |
| 2006/0193478 | A1 | 8/2006 | Setoguchi et al. | |
| 2008/0253576 | A1 * | 10/2008 | Choo | G10L 19/008 381/10 |
| 2009/0110204 | A1 * | 4/2009 | Walsh | H04S 5/005 381/17 |
| 2009/0192806 | A1 | 7/2009 | Truman et al. | |
| 2014/0200899 | A1 * | 7/2014 | Yamamoto | G10L 19/265 704/500 |
| 2016/0203826 | A1 * | 7/2016 | Kaniewska | G10L 21/038 704/500 |

FOREIGN PATENT DOCUMENTS

| | | | |
|---|---|---|---|
| CN | 102027533 | A | 4/2011 |
| EP | 0574288 | A1 | 1/1993 |
| EP | 1918911 | | 5/2008 |
| JP | 2003517157 | A | 2/2004 |
| JP | 2004053940 | A | 2/2004 |
| JP | 2005208627 | A | 8/2005 |
| JP | 2006243006 | A | 9/2006 |
| JP | 2007514977 | A | 6/2007 |
| JP | 2008504566 | A | 2/2008 |
| JP | 2009500952 | A | 1/2009 |
| JP | 2011514987 | A | 5/2011 |
| RU | 2009585 | C1 | 3/1994 |
| WO | 2005059900 | A1 | 6/2005 |
| WO | 2011048792 | A1 | 4/2011 |
| WO | WO-2011039668 | | 4/2011 |
| WO | 2011110494 | A1 | 9/2011 |

OTHER PUBLICATIONS

S. Zhang, W. Dou and H. Yang, "Maximal Coherence Rotation for stereo coding," 2010 IEEE International Conference on Multimedia and Expo, Suntec City, 2010, pp. 1097-1101, doi: 10.1109/ICME.2010.5583555. (Year: 2010).*

Dietz, et al., "Spectral Band Replication, a novel approach in audio coding", 112th AES Convention, Munich, Germany, May 2002, 8 pages.

Dorran, David et al., "Time-scale Modification of Music using a Synchronized Subband / Time-domain Approach", IEEE International Conference on Acoustics, Speech and Signal Processing, vol. 4, Montreal, Canada, 2004, 2004, 225-228.

Faller, Christof et al., "Binaural Cue Coding_Part II: Schemes and Applications", IEEE Transactions on Speech and Audio Processing. vol. 11, No. 6. Nov. 2003, 520-531.

Griesinger, D. et al., "The Relationship between Audience Engagement and the ability to Perceive Pitch, Timbre, Azimuth and Envelopment of Multiple Sources", Tonmeister Tagung 2010, 11 Pages.

Herre, et al., "MPEG Surround—The ISO/MPEG Standard for Efficient and Compatible Multichannel Audio Coding", J. Audio Eng. Soc., vol. 56, No. 11, Nov. 2008, 932-955.

Laroche, Jean , "Frequency-Domain Techniques for High-Quality Voice Modification", Proc. of the 6th Int. Conference on Digital Audio Effects (DAFx-03), London, UK Sep. 8-11, 2003, 2003, 5 Pages.

Laroche, Jean et al., "Phase-Vocoder About the phasiness business", IEEE New Paltz, NY Oct. 1997, Oct. 19, 1997, 4 Pages.

Larsen, et al., "Audio Bandwidth Extension—Application of Psychoacoustics, Signal Processing and Loudspeaker Design", John Wiley & Sons, 2004.

Nagel, F et al., "A Phase Vocoder Driven Bandwidth", 126th AES Convention. Munich, Germany., May 2009, 1-8.

Painter, et al., "Perceptual Coding of Digital Audio", Proc. of the IEEE, vol. 88, No. 4, Apr. 2000, pp. 451-513.

Purnhagen, Heiko et al., "Hiln—The PPEG-4 Parametric Audio Coding Tools", IEEE University of Hannover. Germany, 2000, 4 Pages.

Schuijers, et al., "Advances in Parametric Coding for High-Quality Audio", 114th Convention, Amsterdam, The Netherlands, 2003.

Van Schijndel, NH et al., "Rate-distortion optimized hybrid sound coding", 2005 IEEE Workshop on Applications of Signal Processing to Audio and Acoustics, Oct. 16-19, 2005, pp. 235-238.

Xiph, "Next Generation Audio: Ghost update Jan. 13, 2011", www.Xiph.org (2011), 3 Pages.

* cited by examiner

PHASE COHERENCE CONTROL FOR HARMONIC SIGNALS IN PERCEPTUAL AUDIO CODECS

CROSS-REFERENCE TO RELATED APPLICATIONS

This application is a continuation of International Application No. PCT/EP2013/053831, filed Feb. 26, 2013, which is incorporated herein by reference in its entirety, and additionally claims priority from U.S. Provisional Application No. 61/603,773, filed Feb. 27, 2012, and from European Application No. 12 178 265.0, filed Jul. 27, 2012, which are also incorporated herein by reference in its entirety.

BACKGROUND OF THE INVENTION

The present invention relates to an apparatus and method for generating an audio output signal and, in particular, to an apparatus and method for implementing phase coherence control for harmonic signals in perceptual audio codecs.

Audio signal processing becomes more and more important. In particular, perceptual audio coding has proliferated as a mainstream enabling digital technology for all types of applications that provide audio and multimedia to consumers using transmission or storage channels with limited capacity. Modern perceptual audio codecs are necessitated to deliver satisfactory audio quality at increasingly low bitrates. In turn, one has to put up with certain coding artifacts that are most tolerable by the majority of listeners.

One of these artifacts is the loss of phase coherence over frequency ("vertical" phase coherence), see [8]. For many stationary signals, the resulting impairment in subjective audio signal quality is usually rather small. However, in harmonic tonal sounds consisting of many spectral components that are perceived by the human auditory system as a single compound, the resulting perceptual distortion is objectionable.

Typical signals, where the preservation of vertical phase coherence (VPC) is important, are voiced speech, brass instruments or bowed strings, e.g. 'instruments' that, by the nature of their physical sound production, produce sound that is rich in its overtone content and phase-locked between the harmonic overtones. Especially at very low bitrates where the bit budget is extremely limited, the use of state-of-the-art codecs often substantially weakens the VPC of the spectral components. However, in the signals mentioned before. VPC is an important perceptual auditory cue and a high VPC of the signal should be preserved.

In the following, perceptual audio coding according to the state of the art is considered. In the state of the art, perceptual audio coding follows several common themes, including the use of time/frequency-domain processing, redundancy reduction (entropy coding), and irrelevancy removal through the pronounced exploitation of perceptual effects (see [1]). Typically, the input signal is analyzed by an analysis filter bank that converts the time domain signal into a spectral representation, e.g. a time/frequency representation. The conversion into spectral coefficients allows for selectively processing signal components depending on their frequency content, e.g. different instruments with their individual overtone structures.

In parallel, the input signal is analyzed with respect to its perceptual properties. For example, a time- and frequency-dependent masking threshold may be computed. The time/frequency dependent masking threshold may be delivered to a quantization unit through a target coding threshold in the form of an absolute energy value or a Mask-to-Signal-Ratio (MSR) for each frequency band and coding time frame.

The spectral coefficients delivered by the analysis filter bank are quantized to reduce the data rate needed for representing the signal. This step implies a loss of information and introduces a coding distortion (error, noise) into the signal. In order to minimize the audible impact of this coding noise, the quantizer step sizes are controlled according to the target coding thresholds for each frequency band and frame. Ideally, the coding noise injected into each frequency band is lower than the coding (masking) threshold and thus no degradation in subjective audio is perceptible (removal of irrelevancy). This control of the quantization noise over frequency and time according to psychoacoustic requirements leads to a sophisticated noise shaping effect and is what makes the coder a perceptual audio coder.

Subsequently, modern audio coders perform entropy coding, for example. Huffman coding or arithmetic coding, on the quantized spectral data. Entropy coding is a lossless coding step which further saves bitrate.

Finally, all coded spectral data and relevant additional parameters, e.g. side information, like e.g. the quantizer settings for each frequency band, are packed together into a bitstream, which is the final coded representation intended for file storage or transmission.

Now, bandwidth extension according to the state of the art is considered. In perceptual audio coding based on filter banks, the main part of the consumed bitrate is usually spent on the quantized spectral coefficients. Thus, at very low bitrates, not enough bits may be available to represent all coefficients in the precision necessitated to achieve perceptually unimpaired reproduction. Thereby, low bitrate requirements effectively set a limit to the audio bandwidth that can be obtained by perceptual audio coding.

Bandwidth extension (see [2]) removes this longstanding fundamental limitation. The central idea of bandwidth extension is to complement a band-limited perceptual codec by an additional high-frequency processor that transmits and restores the missing high-frequency content in a compact parametric form. The high frequency content can be generated based on single sideband modulation of the baseband signal, see, for example [3], or on the application of pitch shifting techniques like e.g. the vocoder in [4].

Especially for low bitrates, parametric coding schemes have been designed that encode sinusoidal components (sinusoids) by a compact parametric representation (see, for example, [9], [10], [11] and [12]). Depending on the individual coder, the remaining residual is further subjected to parametric coding or is waveform coded.

In the following, parametric spatial audio coding according to the state of the art is considered. Like bandwidth extension of audio signals, Spatial Audio Coding (SAC) leaves the domain of waveform coding and instead focuses on delivering a perceptually satisfying replica of the original spatial sound image. A sound scene perceived by a human listener is essentially determined by differences between the listener's ear signals (so called inter-aural differences) regardless of whether the scene consists of real audio sources or whether it is reproduced via two or more loudspeakers projecting phantom sound. Instead of discretely encoding the individual audio input channel signals, a system based on SAC captures the spatial image of a multichannel audio signal into a compact set of parameters that can be used to synthesize a high quality multi-channel representation from a transmitted downmix signal (see, for example, [5], [6] and [7]).

Due to its parametric nature, spatial audio coding is not waveform preserving. As a consequence, it is hard to achieve totally unimpaired quality for all types of audio signals. Nonetheless, spatial audio coding is an extremely powerful approach that provides substantial gain at low and intermediate bitrates.

Digital audio effects such as time-stretching or pitch shifting effects are usually obtained by applying time domain techniques like synchronized overlap-add (SOLA), or by applying frequency domain techniques, for example, by employing a vocoder. Moreover, hybrid systems have been proposed in the state of the art which apply a SOLA processing in subbands. Vocoders and hybrid systems usually suffer from an artifact called phasiness which can be attributed to the loss of vertical phase coherence. Some publications relate to improvements on the sound quality of time stretching algorithms by preserving vertical phase coherence where it is important (see, for example, [14] and [15]).

The use of state-of-the-art perceptual audio codecs often weakens the vertical phase coherence (VPC) of the spectral components of an audio signal, especially at low bitrates, where parametric coding techniques are applied. However, in certain signals. VPC is an important perceptual cue. As a result, the perceptual quality of such sounds is impaired.

State-of-the-art audio coders usually compromise the perceptual quality of audio signals by neglecting important phase properties of the signal to be coded (see, for example, [1]). Coarse quantization of the spectral coefficients transmitted in an audio coder can already alter the VPC of the decoded signal. Moreover, especially due to the application of parametric coding techniques, such as bandwidth extension (see [2], [3] and [4]), parametric multichannel coding (see, e.g. [5], [6] and [7]), or parametric coding of sinusoidal components (see [9], [10], [11] and [12]), the phase coherence over frequency is often impaired.

The result is a dull sound that appears to come from a far distance and thus evokes little listener engagement [13]. A lot of signal component types exist, where the vertical phase coherence is important. Typical signals where VPC is important are, for example, tones with rich harmonic overtone content, such as voiced speech, brass instruments or bowed strings.

SUMMARY

According to an embodiment, a decoder for decoding an encoded audio signal to obtain a phase-adjusted audio signal may have: a decoding unit for decoding the encoded audio signal to obtain a decoded audio signal, and a phase adjustment unit for adjusting the decoded audio signal to obtain the phase-adjusted audio signal, wherein the phase adjustment unit is configured to receive control information depending on a vertical phase coherence of the encoded audio signal, and wherein the phase adjustment unit is adapted to adjust the decoded audio signal based on the control information.

According to another embodiment, an encoder for encoding control information based on an audio input signal may have: a transformation unit for transforming the audio input signal from a time-domain to a spectral domain to obtain a transformed audio signal having a plurality of subband signals being assigned to a plurality of subbands, a control information generator for generating the control information such that the control information indicates a vertical phase coherence of the transformed audio signal, and an encoding unit for encoding the transformed audio signal and the control information.

According to another embodiment, an apparatus for processing a first audio signal to obtain an second audio signal may have: a control information generator for generating control information such that the control information indicates a vertical phase coherence of the first audio signal, and a phase adjustment unit for adjusting the first audio signal to obtain the second audio signal, wherein the phase adjustment unit is adapted to adjust the first audio signal based on the control information.

According to another embodiment, a system may have: an encoder as mentioned above, and at least one decoder as mentioned above, wherein the encoder is configured to transform an audio input signal to obtain a transformed audio signal, wherein the encoder is configured to encode the transformed audio signal to obtain an encoded audio signal, wherein the encoder is configured to encode control information indicating a vertical phase coherence of the transformed audio signal, wherein the encoder is arranged to feed the encoded audio signal and the control information into the at least one decoder, wherein the at least one decoder is configured to decode the encoded audio signal to obtain a decoded audio signal, and wherein the at least one decoder is configured to adjust the decoded audio signal based on the encoded control information to obtain a phase-adjusted audio signal.

According to another embodiment, a method for decoding an encoded audio signal to obtain a phase-adjusted audio signal may have the steps of: receiving control information, wherein the control information indicates a vertical phase coherence of the encoded audio signal, decoding the encoded audio signal to obtain a decoded audio signal, and adjusting the decoded audio signal to obtain the phase-adjusted audio signal based on the control information.

According to another embodiment, a method for encoding control information based on an audio input signal may have the steps of: transforming the audio input signal from a time-domain to a spectral domain to obtain a transformed audio signal has a plurality of subband signals being assigned to a plurality of subbands, generating the control information such that the control information indicates a vertical phase coherence of the transformed audio signal, and encoding the transformed audio signal and the control information.

According to another embodiment, a method for processing a first audio signal to obtain an second audio signal may have the steps of: generating control information such that the control information indicates a vertical phase coherence of the first audio signal, and adjusting the first audio signal based on the control information to obtain the second audio signal.

Another embodiment may have a computer program for implementing the above methods when being executed by a computer or signal processor.

In an embodiment, the phase adjustment unit may be configured to adjust the decoded audio signal when the control information indicates that the phase adjustment is activated. The phase adjustment unit may be configured not to adjust the decoded audio signal when the control information indicates that phase adjustment is deactivated.

In another embodiment, the phase adjustment unit may be configured to receive the control information, wherein the control information comprises a strength value indicating a strength of a phase adjustment. Moreover, the phase adjustment unit may be configured to adjust the decoded audio signal based on the strength value.

According to a further embodiment, the decoder may further comprise an analysis filter bank for decomposing the decoded audio signal into a plurality of subband signals of a plurality of subbands. The phase adjustment unit may be configured to determine a plurality of first phase values of the plurality of subband signals. Moreover, the phase adjustment unit may be adapted to adjust the encoded audio signal by modifying at least some of the plurality of the first phase values to obtain second phase values of the phase-adjusted audio signal.

In another embodiment, the phase adjustment unit may be configured to adjust at least some of the phase values by applying the formulae:

$$px'(f)=px(f)-dp(f), \text{ and}$$

$$dp(f)=\alpha*(p0(f)+\text{const}),$$

wherein f is a frequency indicating the one of the subbands which has the frequency f as a center frequency, wherein px(f) is one of the first phase values of one of the subband signals of one of the subbands having the frequency f as the center frequency, wherein px'(f) is one of the second phase values of one of the subband signals of one of the subbands having the frequency f as the center frequency, wherein const is a first angle in the range $-\pi \leq \text{const} \leq \pi n$, wherein $\alpha$ is a real number in the range $0 \leq \alpha \leq 1$; and wherein p0(f) is a second angle in the range $-\pi \leq \mathbf{p0}(f) \leq n$, wherein the second angle p0(f) is assigned to the one of the subbands having the frequency f as the center frequency. Alternatively, the above phase adjustment can also be accomplished by multiplication of a complex subband signal (e.g. the complex spectral coefficients of a Discrete Fourier Transform) by an exponential phase term $e^{-jdp(f)}$, where j is the unit imaginary number.

According to another embodiment, the decoder may further comprise a synthesis filter bank. The phase-adjusted audio signal may be a phase-adjusted spectral-domain audio signal being represented in a spectral domain. The synthesis filter bank may be configured to transform the phase adjusted spectral-domain audio signal from the spectral domain to a time domain to obtain a phase-adjusted time-domain audio signal.

In an embodiment, the decoder may be configured for decoding VPC control information.

Moreover, according to another embodiment, the decoder may be configured to apply control information to obtain a decoded signal with a better preserved VPC than in conventional systems.

Furthermore, the decoder may be configured to manipulate the VPC steered by measurements in the decoder and/or activation information contained in the bitstream.

Moreover, an encoder for encoding control information based on an audio input signal is provided. The encoder comprises a transformation unit, a control information generator and an encoding unit. The transformation unit is adapted to transform the audio input signal from a time-domain to a spectral domain to obtain a transformed audio signal comprising a plurality of subband signals being assigned to a plurality of subbands. The control information generator is adapted to generate the control information such that the control information indicates a vertical phase coherence of the transformed audio signal. The encoding unit is adapted to encode the transformed audio signal and the control information.

In an embodiment, the transformation unit of the encoder comprises a cochlear filter bank for transforming the audio input signal from the time-domain to the spectral domain to obtain the transformed audio signal comprising the plurality of subband signals.

According to a further embodiment, the control information generator may be configured to determine a subband envelope for each of the plurality of subband signals to obtain a plurality of subband signal envelopes. Moreover, the control information generator may be configured to generate a combined envelope based on the plurality of subband signal envelopes. Furthermore, the control information generator may be configured to generate the control information based on the combined envelope.

In another embodiment, the control information generator may be configured to generate a characterizing number based on the combined envelope. Moreover, the control information generator may be configured to generate the control information such that the control information indicates that phase adjustment is activated when the characterizing number is greater than a threshold value. Furthermore, the control information generator may be configured to generate the control information such that the control information indicates that the phase adjustment is deactivated when the characterizing number is smaller than or equal to the threshold value.

According to a further embodiment, the control information generator may be configured to generate the control information by calculating a ratio of a geometric mean of the combined envelope to an arithmetic mean of the combined envelope.

Alternatively, the maximum value of the combined envelope may be compared to a mean value of the combined envelope. For example, a max/mean ratio may be formed, e.g. a ratio of the maximum value of the combined envelope to the mean value of the combined envelope.

In an embodiment, the control information generator may be configured to generate the control information such that the control information comprises a strength value indicating a degree of vertical phase coherence of the subband signals.

An encoder according to an embodiment may be configured for conducting a measurement of VPC on the encoder side through e.g. phase and/or phase derivative measurements over frequency.

Moreover, an encoder according to an embodiment may be configured for conducting a measurement of the perceptual salience of vertical phase coherence.

Furthermore, an encoder according to an embodiment may be configured to conduct a derivation of activation Information from phase coherence salience and/or VPC measurements.

Moreover, an encoder according to an embodiment may be configured to extract of time-frequency adaptive VPC cues or control information.

Furthermore, an encoder according to an embodiment may be configured to determine a compact representation of VPC control information.

In embodiments, VPC control Information may be transmitted in a bitstream.

Moreover, an apparatus for processing a first audio signal to obtain an second audio signal is provided. The apparatus comprises a control information generator, and a phase adjustment unit. The control information generator is adapted to generate control information such that the control information indicates a vertical phase coherence of the first audio signal. The phase adjustment unit is adapted to adjust the first audio signal to obtain the second audio signal. Moreover, the phase adjustment unit is adapted to adjust the first audio signal based on the control information.

Furthermore, a system is provided. The system comprises an encoder according to one of the above-described embodiments and at least one decoder according to one of the above-described embodiments. The encoder is configured to transform an audio input signal to obtain a transformed audio signal. Moreover, the encoder is configured to encode the transformed audio signal to obtain an encoded audio signal. Furthermore, the encoder is configured to encode control information indicating a vertical phase coherence of the transformed audio signal. Moreover, the encoder is arranged to feed the encoded audio signal and the control information into the at least one decoder. The at least one decoder is configured to decode the encoded audio signal to obtain a decoded audio signal. Furthermore, the at least one decoder is configured to adjust the decoded audio signal based on the encoded control information to obtain a phase-adjusted audio signal.

In embodiments, the VPC may be measured on the encoder side, transmitted as appropriate compact side information alongside with the coded audio signal and the VPC of the signal is restored at the decoder. According to alternative embodiments, the VPC is manipulated in the decoder steered by control information generated in the decoder and/or guided by activation information transmitted from the encoder in the side information. The VPC processing may be time-frequency selective such that VPC is only restored where it is perceptually beneficial.

In embodiments, means are provided for preserving the vertical phase coherence (VPC) of signals when the VPC has been compromised by a signal processing, coding or transmission process.

In some embodiments, the inventive system measures the VPC of the input signal prior to its encoding, transmits appropriate compact side information alongside with the coded audio signal and restores VPC of the signal at the decoder based on the transmitted compact side information. Alternatively, the inventive method manipulates VPC in the decoder steered by control information generated in the decoder and/or guided by activation information transmitted from the encoder in the side information.

In other embodiments, the VPC of an impaired signal can be processed to restore its original VPC by using a VPC adjustment process which is controlled by analysing the impaired signal itself.

In both cases, said processing can be time-frequency selective such that VPC is only restored where it is perceptually beneficial.

Improved sound quality of perceptual audio coders is provided at moderate side information costs. Besides perceptual audio coders, the measurement and restoration of the VPC is also beneficial for digital audio effects based on phase vocoders, like time stretching or pitch shifting.

BRIEF DESCRIPTION OF THE DRAWINGS

In the following, embodiments are described with respect to the figures in which.

DETAILED DESCRIPTION OF THE INVENTION

Figure 1A:
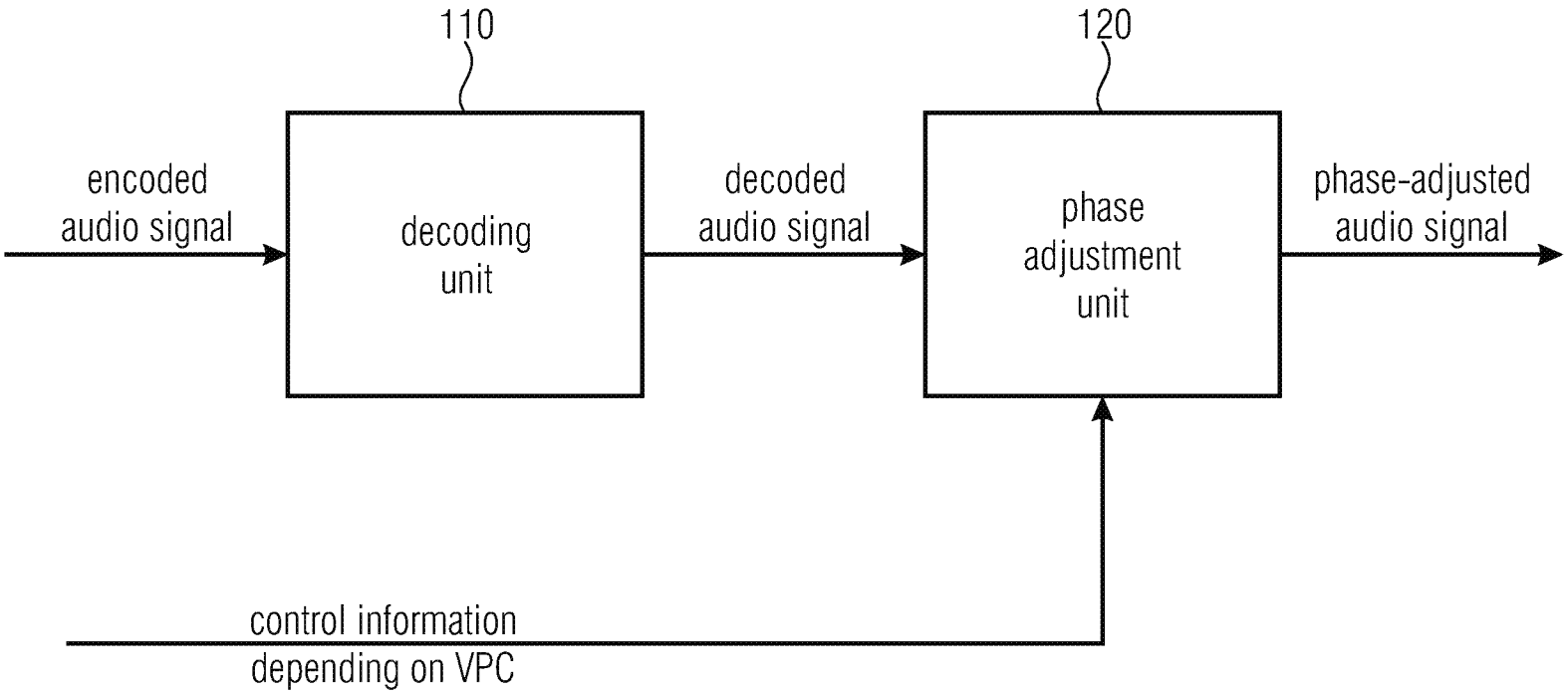
FIG. 1*a* illustrates a decoder for decoding an encoded audio signal to obtain a phase-adjusted audio signal according to an embodiment.

FIG. 1*a* illustrates a decoder for decoding an encoded audio signal to obtain a phase-adjusted audio signal according to an embodiment. The decoder comprises a decoding unit 110 and a phase adjustment unit 120. The decoding unit 110 is adapted to decode the encoded audio signal to obtain a decoded audio signal. The phase adjustment unit 120 is adapted to adjust the decoded audio signal to obtain the phase-adjusted audio signal.

Moreover, the phase adjustment unit 120 is configured to receive control information depending on a vertical phase coherence (VPC) of the encoded audio signal. Furthermore, the phase adjustment unit 120 is adapted to adjust the decoded audio signal based on the control information.

The embodiment of FIG. 1*a* takes into account that for certain audio signals it is important to restore the vertical phase coherence of the encoded signal. For example, when the audio signal portion comprises voiced speech, brass instruments or bowed strings, preservation of the vertical phase coherence is important. For this purpose, the phase adjustment unit 120 is adapted to receive control information which depends on the VPC of the encoded audio signal.

For example, when the encoded signal portions comprise voiced speech, brass instruments or bowed strings, then the VPC of the encoded signal is high. In such cases, the control information may indicate that phase adjustment is activated.

Other signal portions may not comprise pulse-like tonal signals or transients, and the VPC of such signal portions may be low. In such cases, the control information may indicate that phase adjustment is deactivated.

In other embodiments, the control information may comprise a strength value. Such a strength value may indicate a strength of the phase adjustment that shall be performed. For example, the strength value may be a value $\alpha$ with $0 \leq \alpha \leq 1$. If $\alpha=1$ or close to 1 this may indicate a high strength value. Significant phase adjustments will be conducted by the phase adjustment unit 120. If $\alpha$ is close to 0, only minor phase adjustments will be conducted by the phase adjustment unit 120. If $\alpha=0$, no phase adjustments will be conducted at all.

Figure 1B:
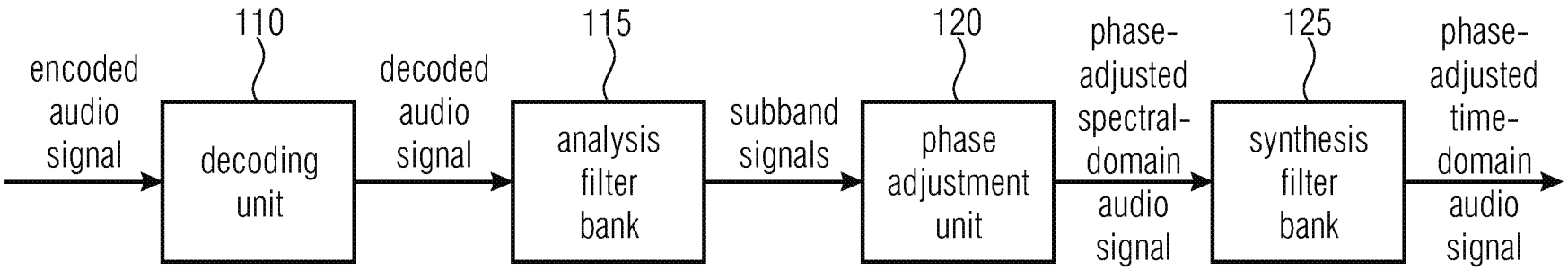
FIG. 1*b* illustrates a decoder for decoding an encoded audio signal to obtain a phase-adjusted audio signal according to another embodiment.

FIG. 1*b* illustrates a decoder for decoding an encoded audio signal to obtain a phase-adjusted audio signal according to another embodiment. Besides the decoding unit 110 and the phase adjustment unit 120, the decoder of FIG. 1*b* comprises an analysis filter bank 115 and a synthesis filter bank 125.

The analysis filter bank 115 is configured to decompose the decoded audio signal into a plurality of subband signals of a plurality of subbands. The phase adjustment unit 120 of FIG. 1*b* may be configured to determine a plurality of first phase values of the plurality of subband signals. Moreover, the phase adjustment unit 120 may be adapted to adjust the encoded audio signal by modifying at least some of the plurality of the first phase values to obtain second phase values of the phase-adjusted audio signal.

The phase-adjusted audio signal may be a phase-adjusted spectral-domain audio signal being represented in a spectral domain. The synthesis filter bank 125 of FIG. 1*b* may be configured to transform the phase adjusted spectral-domain audio signal from the spectral domain to a time domain to obtain a phase-adjusted time-domain audio signal.

Figure 2:
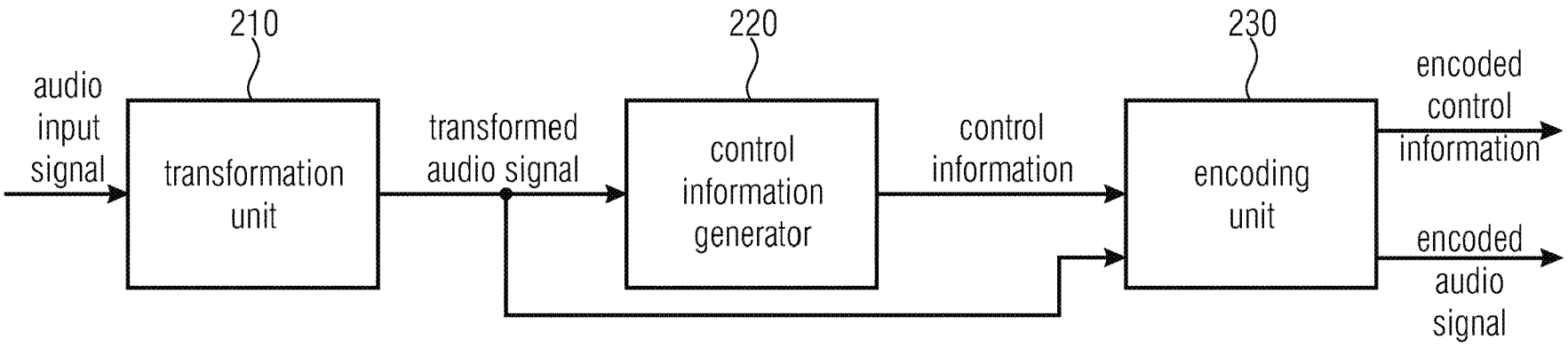
FIG. 2 illustrates an encoder for encoding control information based on an audio input signal according to an embodiment.

FIG. 2 depicts a corresponding encoder for encoding control information based on an audio input signal according to an embodiment. The encoder comprises a transformation unit 210, a control information generator 220 and an encoding unit 230. The transformation unit 210 is adapted to transform the audio input signal from a time-domain to a spectral domain to obtain a transformed audio signal comprising a plurality of subband signals being assigned to a plurality of subbands. The control information generator 220 is adapted to generate the control information such that the control information indicates a vertical phase coherence (VPC) of the transformed audio signal. The encoding unit 230 is adapted to encode the transformed audio signal and the control information.

The encoder of FIG. 2 is adapted to encode control information which depends on the vertical phase coherence of the audio signal to be encoded. To generate the control information, the transformation unit 210 of the encoder transforms the audio input signal into a spectral domain such that the resulting transformed audio signal comprises a plurality of subband signals of a plurality of subbands.

Afterwards, the control information generator 220 then determines information that depends on the vertical phase coherence of the transformed audio signal.

For example, the control information generator 220 may classify a particular audio signal portion as a signal portion where the VPC is high and, for example, set a value $\alpha=1$. For other signal portions, the control information generator 220 may classify a particular audio signal portion as a signal portion where the VPC is low and, for example, set a value $\alpha=0$.

In other embodiments, the control information generator 220 may determine a strength value which depends on the VPC of the transformed audio signal. For example, the control information generator may assign a strength value regarding an examined signal portion, wherein the strength value depends on the VPC of the signal portion. On a decoder side, the strength value may then be employed to determine whether only small phase adjustments shall be conducted or whether strong phase adjustments shall be conducted with respect to the subband phase values of a decoded audio signal to restore the original VPC of the audio signal.

Figure 3:
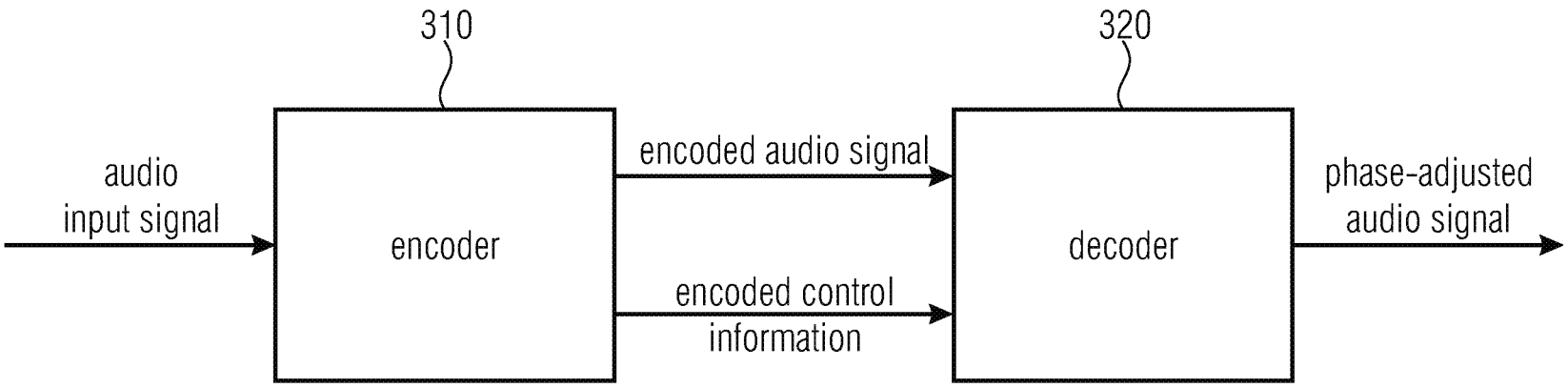
FIG. 3 illustrates a system according to an embodiment comprising an encoder and at least one decoder.

FIG. 3 illustrates another embodiment. In FIG. 3, a system is provided. The system comprises an encoder 310 and at least one decoder. While FIG. 3 only illustrates a single decoder 320, other embodiments may comprise more than one decoder. The encoder 310 of FIG. 3 may be an encoder of the embodiment of FIG. 2. The decoder 320 of FIG. 3 may be the decoder of the embodiment of FIG. 1*a* or of the embodiment of FIG. 1*b*. The encoder 310 of FIG. 3 is configured to transform an audio input signal to obtain a transformed audio signal (not shown). Moreover, the encoder 310 is configured to encode the transformed audio signal to obtain an encoded audio signal. Furthermore, the encoder is configured to encode control information indicating a vertical phase coherence of the transformed audio signal. The encoder is arranged to feed the encoded audio signal and the control information into the at least one decoder.

The decoder 320 of FIG. 3 is configured to decode the encoded audio signal to obtain a decoded audio signal (not shown). Furthermore, the decoder 320 is configured to adjust the decoded audio signal based on the encoded control information to obtain a phase-adjusted audio signal.

Summarizing the foregoing, the above-described embodiments aim at preserving the vertical phase coherence of signals especially in signal portions with a high degree of vertical phase coherence.

The proposed concepts improve the perceptual quality that is delivered by an audio processing system, in the following also referred to as "audio system", by measuring the VPC characteristics of the input signal to the audio processing system and by adjusting the VPC of the output signal produced by the audio system based on the measured VPC characteristics to form a final output signal, such that the intended VPC of the final output signal is achieved.

Figure 4:
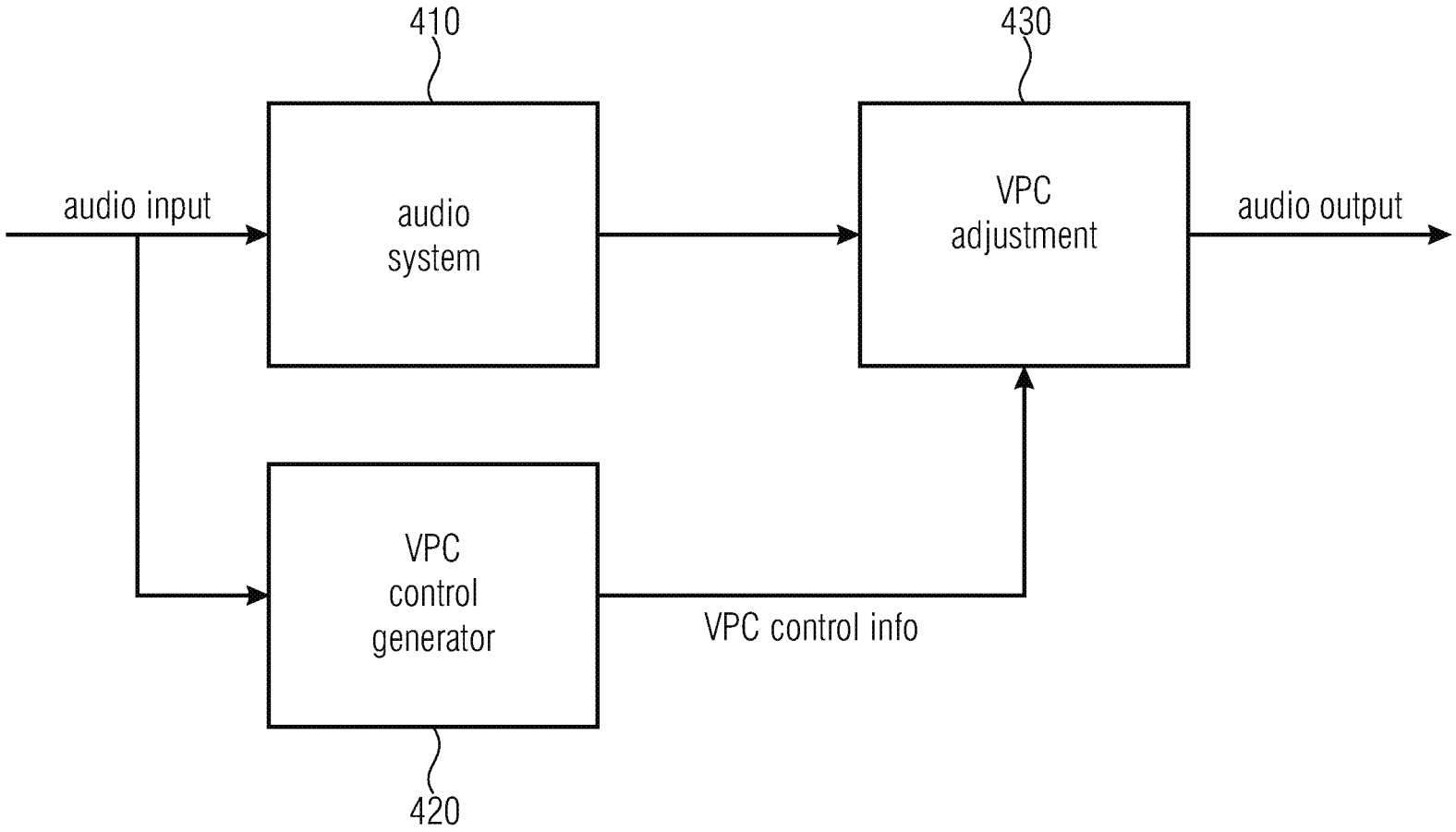
FIG. 4 illustrates an audio processing system with VPC processing according to an embodiment.

FIG. 4 displays a general audio processing system that is enhanced by the above-described embodiment. In particular, FIG. 4 depicts a system for VPC processing. From the input signal of an audio system 410, a VPC Control Generator 420 measures the VPC and/or its perceptual salience, and generates a VPC control information. The output of the audio system 410 is fed into a VPC Adjustment Unit 430, and the VPC control information is used in the VPC adjustment unit 430 in order to reinstate the VPC.

As an important practical case, this concept can be applied e.g. to conventional audio codecs by measuring the VPC and/or the perceptual salience of phase coherence an the encoder side, transmitting appropriate compact side information alongside with the coded audio signal and restoring the VPC of the signal at the decoder, based on the transmitted compact side information.

Figure 5:
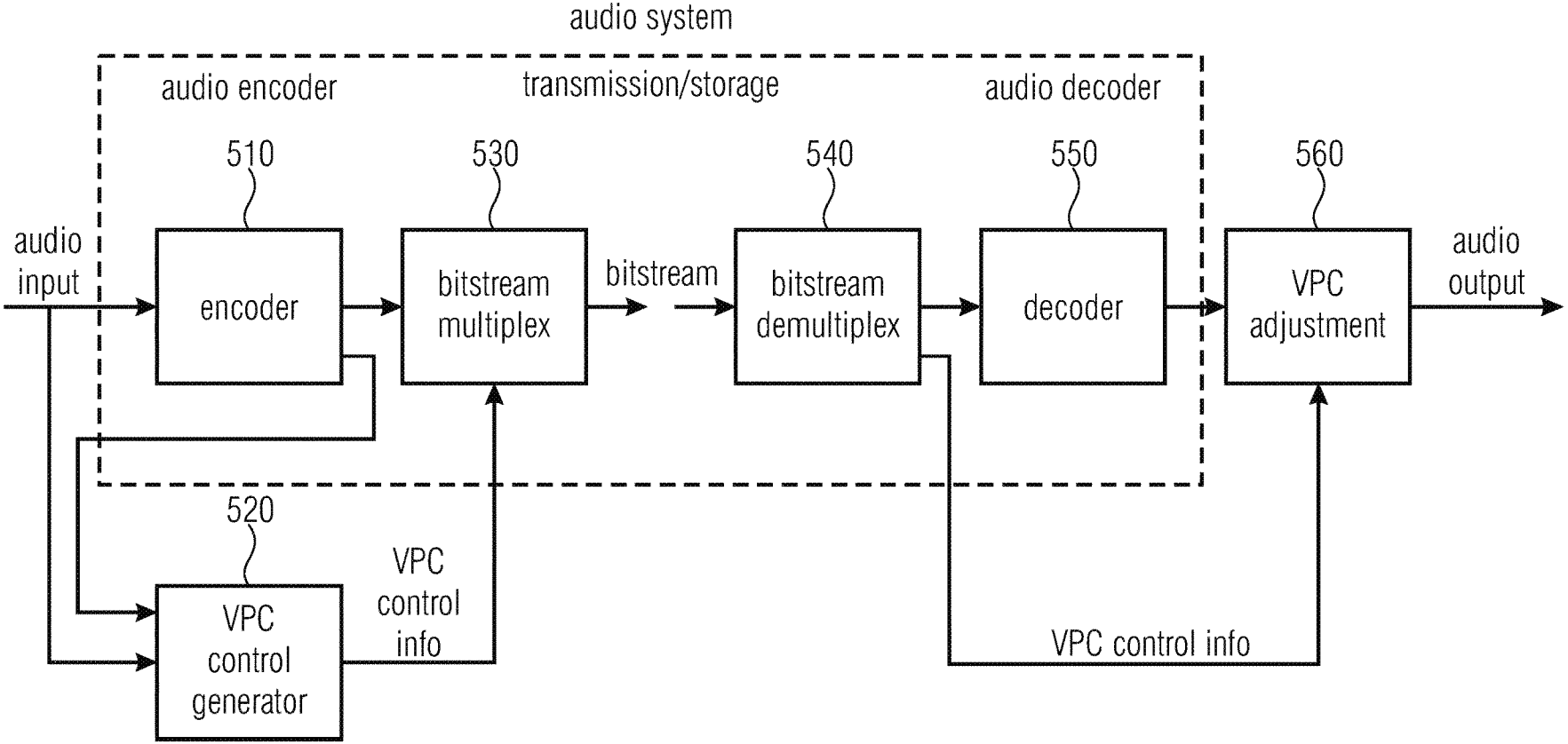
FIG. 5 depicts a perceptual audio encoder and decoder according to an embodiment.

FIG. 5 illustrates a perceptual audio encoder and decoder according to an embodiment. In particular, FIG. 5 depicts a perceptual audio codec implementing a two-sided VPC processing.

On an encoder side, an encoding unit 510, a VPC control generator 520 and a bitstream multiplex unit 530 are illustrated. On a decoder side, a bitstream demultiplex unit 540, a decoding unit 550 and a VPC adjustment unit 560 are depicted.

On the encoder side, a VPC control information is generated by the VPC control generator 520 and coded as a compact side information that is multiplexed by the multiplex unit 530 into the bitstream alongside with the coded audio signal. The generation of VPC control information can be time-frequency selective such that VPC is only measured and control information is only coded were it is perceptually beneficial.

At the decoder side, the VPC control information is extracted by the bitstream demultiplex unit 540 from the bitstream and is applied in the VPC adjustment unit 560 in order to reinstate the proper VPC.

Figure 6:
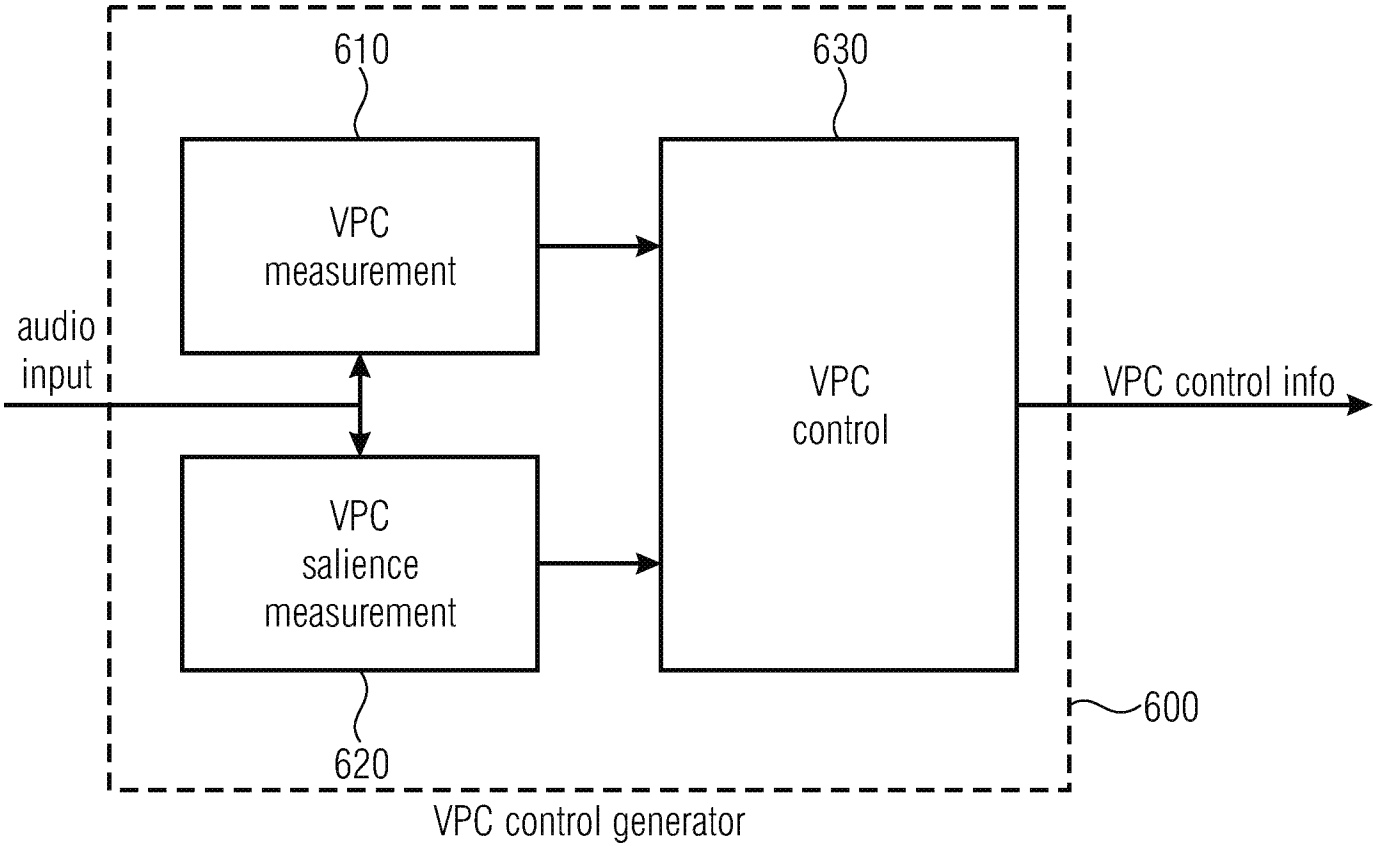
FIG. 6 illustrates a VPC control generator according to an embodiment.

FIG. 6 illustrates some details of a possible implementation of a VPC control generator 600. On the input audio signal, the VPC is measured by a VPC measurement unit 610 and the perceptual salience of VPC is measured by a VPC salience measurement unit 620. From these, VPC control information is derived by a VPC control information derivation unit 630. The audio input may comprise more than one audio signal, e.g. in addition to the first audio input, a second audio input comprising a processed version of the first input signal (see FIG. 5) may be applied to the VPC control generator.

In embodiments, the encoder side may comprise a VPC control generator for measuring VPC of the input signal and/or measurement of the perceptual salience of the input signal's VPC. The VPC control generator may provide VPC control information for controlling the VPC adjustment on a decoder side. For example, the control information may signal enabling or disabling of the decoder side VPC adjustment or, the control information may determine the strength of the decoder side VPC adjustment.

As the vertical phase coherence is important for the subjective quality of the audio signal, if the signal is tonal and/or harmonic, and if its pitch does not change too rapidly, a typical implementation of a VPC control unit may include a pitch detector or a harmonicity detector or, at least a pitch variation detector, providing a measure of the pitch strength.

Moreover, the control information generated by the VPC control generator may signal the strength of the VPC of the original signal. Or, the control information may signal a modification parameter that drives the decoder VPC adjustment such that, after decoder side VPC adjustment, the original signal's perceived VPC is approximately restored.

Alternatively or additionally, one or several target VPC values to be instated may be signaled.

The VPC control information may be transmitted compactly from the encoder to the decoder side e.g. by embedding it into the bitstream as additional side information.

In embodiments, the decoder may be configured to read the VPC control information provided by the VPC control generator of the encoder side. For this purpose, the decoder may read the VPC control information from the bitstream. Moreover, the decoder may be configured to process the output of the regular audio decoder depending on the VPC control information by employing a VPC adjustment unit. Furthermore, the decoder may be configured to deliver the processed audio signal as the output signal In the following, an encoder-side VPC control generator according to an embodiment is provided.

Quasi-stationary periodic signals that exhibit a high VPC can be identified by use of a pitch detector (as they are well-known from e.g. speech coding or music signal analysis) that delivers a measurement of pitch strength and/or the degree of periodicity. The actual VPC can be measured by application of a cochlear filter bank, a subsequent subband envelope detection followed by a summation of cochlear envelopes across frequency. If, for instance, the subband envelopes are coherent, the summation delivers a temporally non-flat signal, whereas non-coherent subband envelopes add up to a temporally more flat signal. From the combined evaluation (for example, by comparing with predefined thresholds, respectively) of pitch strength and/or degree of periodicity and VPC measure, the VPC Control info can be derived, consisting e.g. of a signal flag denoting 'VPC adjustment on' or else 'VPC adjustment off'.

Impulse-like events in a time-domain exhibit a strong phase coherence regarding their spectral representations. For example, a Fourier-transformed Dirac impulse has a flat spectrum with linearly increasing phases. The same holds true for a series of periodic pulses having a base frequency of f_0. Here, the spectrum is a line spectrum. These single lines which have a frequency distance of f_0 are also phase coherent. When their phase coherence is disturbed (magnitudes remain unmodified), the resulting time-domain signal is no longer a series of Dirac pulses, but instead, the pulses have been significantly broadened in time. This modification is audible and is particularly relevant for sounds which are similar to a series of pulses, for example, voiced speech, brass instruments or bowed strings.

Therefore, VPC may be measured indirectly by determining local non-flatness of an envelope of an audio signal in time (the absolute values of the envelope may be considered).

By summing subband envelopes across frequency, it can be determined whether the envelopes sum up to a flat combined envelope (low VPC) or to a non-flat combined envelope (high VPC). The proposed concept is particularly advantageous, if the summed envelopes relate to perceptually adapted aurally-accurate frequency bands.

The control information may then, for example, be generated by calculating a ratio of a geometric mean of the combined envelope to an arithmetic mean of the combined envelope.

Alternatively, the maximum value of the combined envelope may be compared to a mean value of the combined envelope. For example, a max/mean ratio may be formed, e.g. a ratio of the maximum value of the combined envelope to the mean value of the combined envelope.

Instead of forming a combined envelope, e.g. a sum of envelopes, the phase values of the spectrum of the audio signal that shall be encoded may themselves be examined for predictability. A high predictability indicates a high VPC. A low predictability indicates a low VPC.

Employing a cochlear filter bank is particularly advantageous with respect to audio signals, if the VPC or the VPC salience shall be defined as a psychoacoustic measure. Since the choice of a particular filter bandwidth defines, which partial tones of the spectrum relate to a common subband, and thus jointly contribute to form a certain subband envelope, perceptually adapted filters can model the internal processing of the human hearing system most accurately.

The difference in aural perception between a phase-coherent and a phase-incoherent signal having the same magnitude spectra is moreover dependent on the dominance of harmonic spectral components in the signal (or in the plurality of signals). A low base frequency, e.g. 100 Hz of those harmonic components increases the difference which a high base frequency reduces the difference, because a low base frequency results in more overtones being assigned to the same subband. Those overtones in the same subband again sum up and their subband envelope can be examined.

Moreover, the amplitude of the overtones is relevant. If the amplitude of the overtones is high, the increase of the time-domain envelope becomes sharper, the signal becomes more pulse-like and thus, the VPC becomes increasingly important, e.g. the VPC becomes higher.

In the following, a decoder-side VPC adjustment unit according to an embodiment is provided. Such a VPC adjustment unit may comprise control information comprising a VPC Control info flag.

If VPC Control info flag denotes 'VPC adjustment off'" no dedicated VPC processing is applied ("pass through", or, alternatively, a simple delay). If the flag reads "VPC adjustment on", the signal segment is decomposed by an analysis filter bank and a measurement of the phase p0(f) of each spectral line at frequency f is initiated. From this, phase adjustment Offsets $dp(f)=\alpha*(p0(f)+const)$ are calculated where 'const' denotes an angle in radians between $-\pi$ and $\pi$. For said signal segment and the following consecutive segments, where "VPC adjustment on" is signalled, the phases px(f) of the spectral lines x(f) are then adjusted to be $px'(f)=px(f)-dp(f)$. The VPC adjusted signal is finally converted to time domain by a synthesis filter bank.

The concept is based on the idea to conduct an initial measurement to determine a deviation from an ideal phase response. This deviation is compensated later on. $\alpha$ may be an angle in the range $0 \leq \alpha \leq 1$. $\alpha=0$ means no compensation, $\alpha=1$ means full compensation regarding the ideal phase response. The ideal phase response may for example be the phase response resulting in a phase response with maximal flatness. "const" is a fixed additive angle which does not change the phase coherence, but which allows to steer alternative absolute phases, and thus to generate corresponding signals, e.g. the Hilbert transform of the signal when const is 90°.

Figure 7:
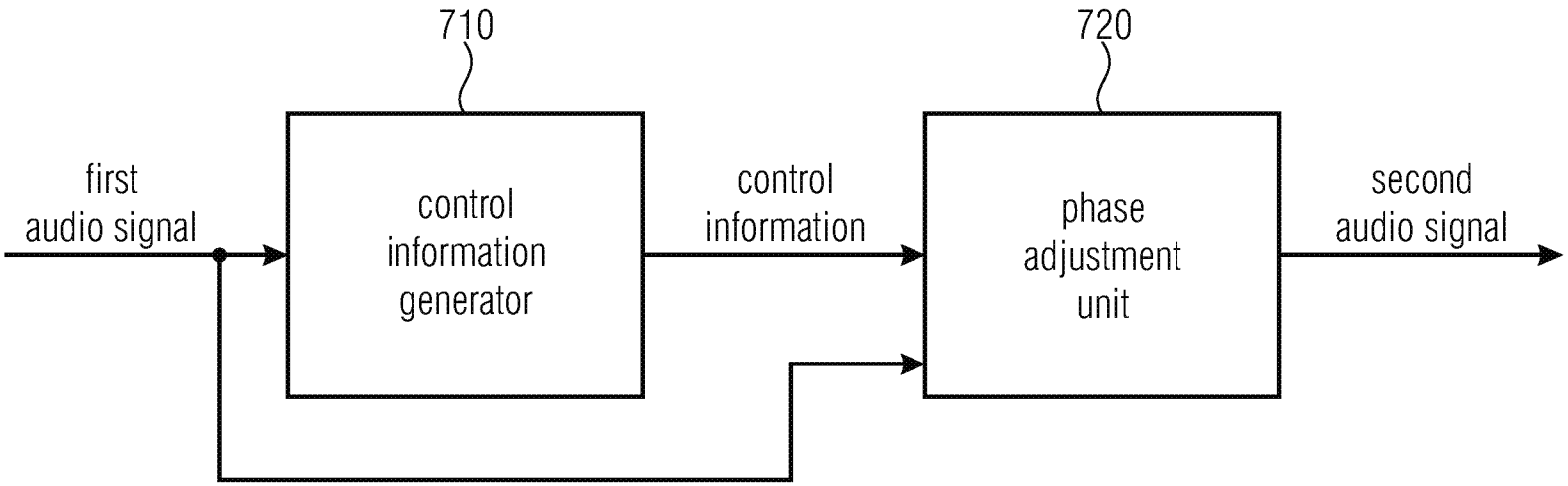
FIG. 7 illustrates an apparatus for processing an audio signal to obtain a second audio signal according to an embodiment.

FIG. 7 illustrates an apparatus for processing a first audio signal to obtain an second audio signal according to another embodiment. The apparatus comprises a control information generator 710, and a phase adjustment unit 720. The control information generator 710 is adapted to generate control information such that the control information indicates a vertical phase coherence of the first audio signal. The phase adjustment unit 720 is adapted to adjust the first audio signal to obtain the second audio signal. Moreover, the phase adjustment unit 720 is adapted to adjust the first audio signal based on the control information.

FIG. 7 is a single-side embodiment. The determination of the control information and the phase adjustments conducted are not split between an encoder (control information generation) and a decoder (phase adjustment). Instead, the control information generation and the phase adjustment are conducted by a single apparatus or system.

Figure 8:
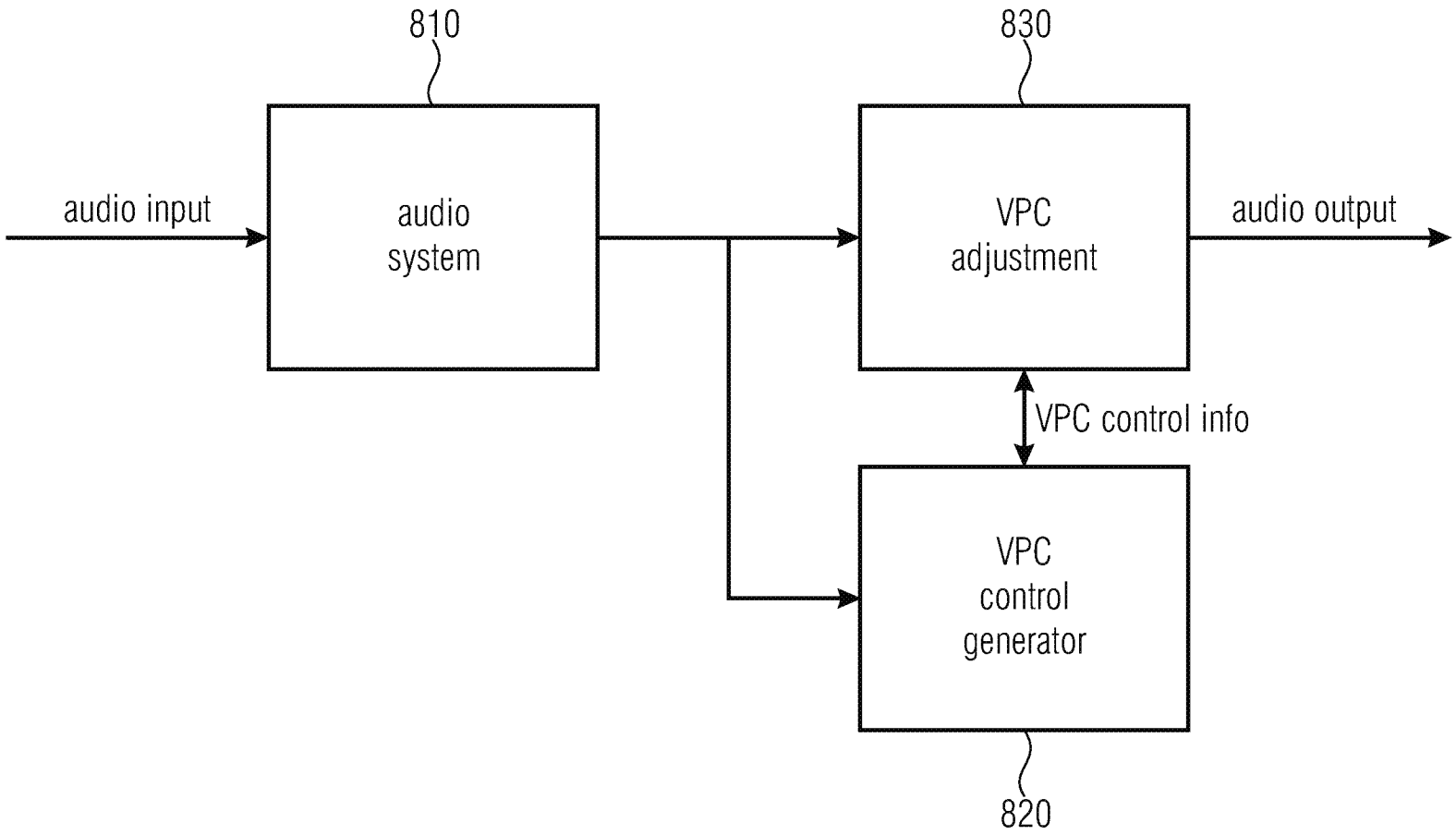
FIG. 8 illustrates an audio processing system VPC processing according to another embodiment.

In FIG. 8, the VPC is manipulated in the decoder steered by control information also generated on the decoder side ("single-sided system"), wherein the control information is generated by analysing the decoded audio signal. In FIG. 8, a perceptual audio codec with a single-sided VPC processing according to an embodiment is illustrated.

A single-sided system according to embodiments as, for example illustrated by FIG. 7 and FIG. 8, may have the following characteristics:

The output of any existing signal processing process or of an audio system, e.g. the output signal of an audio decoder, is processed without having access to VPC control information that is generated with access to an unimpaired/original signal (e.g. on an encoder side). Instead, the VPC control information may be generated directly from the given signal, e.g. from the output of an audio system, e.g. a decoder, (the VPC control information may be "blindly" generated).

The VPC control information for controlling the VPC adjustment may comprise e.g. signals for enabling/disabling the VPC adjustment unit or for determining the strength of the VPC adjustment, or the VPC control information may comprise one or several target VPC values to be instated.

Moreover, the processing may be performed in a VPC adjustment stage, (a VPC adjustment unit) which uses the blindly generated VPC control information and delivers its output as the system output.

In the following, an embodiment of a decoder-side VPC control generator is provided. The decoder-side control generator may be be quite similar to the encoder-side control generator. It may e.g. comprise a pitch detector that delivers a measurement of pitch strength and/or the degree of periodicity and a comparison with a predefined threshold. However, the threshold may be different from the one used in the encoder-side control generator since the decoder-side VPC generator operates on the already VPC-distorted signal. If the VPC distortion is mild, also the remaining VPC can be measured and compared to a given threshold in order to generate VPC control information.

According to an embodiment, if the measured VPC is high. VPC modification is applied in order to further increase the VPC of the output signal, and, if the measured VPC is low, no VPC modification is applied. Since the preservation of VPC is most important for tonal and harmonic signals, for VPC processing according to an embodiment, a pitch detector or, at least a pitch variation detector may be employed, providing a measure of the strength of the dominant pitch.

Finally, the two-sided approach and the single-sided approach can be combined, wherein the VPC adjustment process is controlled by both transmitted VPC control information derived from an original/unimpaired signal and information extracted from the processes (e.g. decoded) audio signal. For example, a combined system results from such a combination.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier or a non-transitory storage medium.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Painter, T.; Spanias. A. Perceptual coding of digital audio, Proceedings of the IEEE, 88(4), 2000; pp. 451-513.

[2] Larsen, E.; Aarts. R. Audio Bandwidth Extension: Application of psychoacoustics, signal processing and loudspeaker design, John Wiley and Sons Ltd. 2004. Chapters 5, 6.

[3] Dietz, M.; Liljeryd, L.; Kjorling, K.; Kunz. 0. Spectral Band Replication, a Novel Approach in Audio Coding, 112th AES Convention, April 2002, Preprint 5553.

[4] Nagel, F.; Disch, S.; Rettelbach, N. A Phase Vocoder Driven Bandwidth Extension Method with Novel Transient Handling for Audio Codecs. 126th AES Convention, 2009.

[5] Faller, C.; Baumgarte, F. Binaural Cue Coding-Part H: Schemes and applications. IEEE Trans. On Speech and Audio Processing, Vol. 11, No. 6, November 2003.

[6] Schuijers, E.; Breebaart. J.; Purnhagen. H.; Engdegard, J. Low complexity parametric stereo coding, 116th AES Convention, Berlin, Germany, 2004; Preprint 6073.

[7] Herre, J.; Kjorling, K.; Breebaart, J. et al. MPEG Surround—The ISO/MPEG Standard for Efficient and Compatible Multichannel Audio Coding, Journal of the AES. Vol. 56, No. 11, November 2008; pp. 932-955.

[8] Laroche, J.; Dolson, M., "Phase-vocoder: about this phasiness business," Applications of Signal Processing to Audio and Acoustics, 1997. 1997 IEEE ASSP Workshop on, vol., no., pp. 4 pp., 19-22, October 1997

[9] Purnhagen, H.; Meine, N.; "HILN—the MPEG-4 parametric audio coding tools," Circuits and Systems, 2000. Proceedings. ISCAS 2000 Geneva. The 2000 IEEE International Symposium on, vol. 3, no., pp. 201-204 vol. 3, 2000

[10] Oomen, Werner; Schuijers, Erik; den Brinker. Bert; Breebaart, Jeroen," Advances in Parametric Coding for High-Quality Audio," Audio Engineering Society Convention 114, preprint, Amsterdam/NL, March 2003

[11] van Schijndel, N. H.; van de Par, S.; "Rate-distortion optimized hybrid sound coding." Applications of Signal Processing to Audio and Acoustics, 2005. IEEE Workshop on, vol., no., pp. 235-238, 16-19 Oct. 2005

[12] http://people.xiph.org/-xiphmont/demo/ghost/demo.html

[13]D. Griesinger The Relationship between Audience Engagement and the ability to Perceive Pitch, Timbre. Azimuth and Envelopment of Multiple Sources' Tonmeister Tagung 2010.

[14]D. Dorran and R. Lawlor, "Time-scale modification of music using a synchronized subband/timedomain approach," IEEE International Conference on Acoustics, Speech and Signal Processing, pp. IV 225-IV 228, Montreal. May 2004.

[15]J. Laroche, "Frequency-domain techniques for high quality voice modification," Proceedings of the International Conference on Digital Audio Effects, pp. 328-322, 2003.

The invention claimed is:

1. An apparatus for audio decoding for decoding an encoded audio signal to acquire a modified audio signal, comprising:

a decoding unit; for decoding the encoded audio signal to acquire a decoded audio signal, and a phase adjustment unit, wherein the phase adjustment unit is configured to receive the decoded audio signal, wherein the phase adjustment unit is configured to receive control information indicating a vertical phase coherence of the encoded audio signal, and wherein, to acquire the modified audio signal being adjusted in phase, the phase adjustment unit is adapted to modify the decoded audio signal using the vertical phase coherence of the control information, wherein the audio decoder is implemented using a hardware apparatus or using a computer or using a combination of a hardware apparatus and a computer.

2. The apparatus according to claim 1, wherein the phase adjustment unit is configured to adjust the decoded audio signal when the control information indicates that the phase adjustment is activated, and wherein the phase adjustment unit is configured not to adjust the decoded audio signal when the control information indicates that phase adjustment is deactivated.

3. The apparatus according to claim 1, wherein the phase adjustment unit is configured to receive the control information, wherein the control information comprises a strength value indicating a strength of a phase adjustment, and wherein the phase adjustment unit is configured to adjust the decoded audio signal based on the strength value.

4. The apparatus according to claim 1, wherein the audio decoder further comprises an analysis filter bank for decomposing the decoded audio signal into a plurality of subband signals of a plurality of subbands, wherein the phase adjustment unit is configured to determine a plurality of first phase values of the plurality of subband signals, and wherein the phase adjustment unit is adapted to adjust the encoded audio signal by modifying at least some of the plurality of the first phase values to acquire second phase values of the phase-adjusted audio signal.

5. The apparatus according to claim 4, wherein the phase adjustment unit is configured to adjust at least some of the phase values by applying the formulae:

$px'(f)=px(f)-dp(f)$, and $dp(f)=\alpha*(p0(f)+\text{const})$, wherein f is a frequency indicating the one of the subbands which comprises the frequency f as a center frequency, wherein px(f) is one of the first phase values of one of the subband signals of one of the subbands comprising the frequency f as the center frequency, wherein px'(f) is one of the second phase values of one of the subband signals of one of the subbands comprising the frequency f as the center frequency, wherein const is a first angle in the range $-\pi<\text{const}<\pi$, wherein $\alpha$ is a real number in the range $0<\alpha<1$; and wherein p0(f) is a second angle in the range $-\pi<p0(f)<\pi$, wherein the second angle p0(f) is assigned to the one of the subbands comprising the frequency f as the center frequency.

6. The apparatus according to claim 4, wherein the phase adjustment unit is configured to adjust at least some of the phase values by multiplying at least some of the plurality of subband signals by an exponential phase term, wherein the exponential phase term is defined by the formula $e^{-jdp(f)}$, wherein the plurality of subband signals are complex subband signals, and wherein j is the unit imaginary number.

7. The apparatus according to claim 1, wherein the audio decoder further comprises a synthesis filter bank, wherein the phase-adjusted audio signal is a phase-adjusted spectral-domain audio signal being represented in a spectral domain, and wherein the synthesis filter bank is configured to transform the phase adjusted spectral-domain audio signal from the spectral domain to a time domain to acquire a phase-adjusted time-domain audio signal.

8. An apparatus for audio encoding for encoding control information based on an audio input signal, comprising:

a transformation unit for transforming the audio input signal from a time-domain to a spectral domain to acquire a transformed audio signal comprising a plurality of subband signals being assigned to a plurality of subbands, a control information generator for generating the control information which indicates a vertical phase coherence of the transformed audio signal, and an encoding unit for encoding the transformed audio signal and the control information to obtain encoded audio information that is decodable, wherein the audio encoder is implemented using a hardware apparatus or using a computer or using a combination of a hardware apparatus and a computer.

9. The apparatus according to claim 8, wherein the transformation unit comprises a cochlear filter bank for transforming the audio input signal from the time-domain to the spectral domain to acquire the transformed audio signal comprising the plurality of subband signals.

10. The apparatus according to claim 8, wherein the control information generator is configured to determine a subband envelope for each of the plurality of subband signals to acquire a plurality of subband signal envelopes, wherein the control information generator is configured to generate a combined envelope based on the plurality of subband signal envelopes, and wherein the control information generator is configured to generate the control information based on the combined envelope.

11. The apparatus according to claim 10, wherein the control information generator is configured to generate a characterizing number based on the combined envelope, and wherein the control information generator is configured to generate the control information such that the control information indicates that phase adjustment is activated when the characterizing number is greater than a threshold value, and wherein the control information generator is configured to generate the control information such that the control information indicates that the phase adjustment is deactivated when the characterizing number is smaller than or equal to the threshold value.

12. The apparatus according to claim 10, wherein the control information generator is configured to generate the control information by calculating a ratio of a geometric mean of the combined envelope to an arithmetic mean of the combined envelope.

13. The apparatus according to claim 8, wherein the control information generator is configured to generate the control information such that the control information comprises a strength value indicating a degree of vertical phase coherence of the subband signals.

14. An apparatus for modifying a first audio signal to acquire a second audio signal, comprising:

a control information generator for generating control information such that the control information indicates a vertical phase coherence of the first audio signal, and a phase adjustment unit for modifying the first audio signal to acquire the second audio signal, wherein the phase adjustment unit is adapted to modify the first audio signal using the vertical phase coherence of the control information, wherein the apparatus is implemented using a hardware apparatus or using a computer or using a combination of a hardware apparatus and a computer.

15. A system comprising, an apparatus for audio encoding for encoding control information based on an audio input signal, comprising: a transformation unit for transforming the audio input signal from a time-domain to a spectral domain to acquire a transformed audio signal comprising a plurality of subband signals being assigned to a plurality of subbands, a control information generator for generating the control information such that the control information indicates a vertical phase coherence of the transformed audio signal, and an encoding unit for encoding the transformed audio signal and the control information, and at least one apparatus for audio decoding according to claim 1, wherein the apparatus for audio encoding is configured to transform an audio input signal to acquire a transformed audio signal, wherein the apparatus for audio encoding is configured to encode the transformed audio signal to acquire an encoded audio signal, wherein the apparatus for audio encoding is configured to encode control information indicating a vertical phase coherence of the transformed audio signal, wherein the apparatus for audio encoding is arranged to feed the encoded audio signal and the control information into the at least one audio decoder, wherein the at least one apparatus for audio decoding is configured to decode the encoded audio signal to acquire a decoded audio signal, and wherein the at least one apparatus for audio decoding is configured to adjust the decoded audio signal based on the encoded control information to acquire a phase-adjusted audio signal, wherein at least one of the apparatus for audio encoding and the at least one apparatus for audio decoding is implemented using a hardware apparatus or using a computer or using a combination of a hardware apparatus and a computer.

16. A method for decoding an encoded audio signal to acquire a modified audio signal, comprising:

decoding the encoded audio signal to acquire a decoded audio signal, and receiving the decoded audio signal, receiving control information indicating a vertical phase coherence of the encoded audio signal, and modifying, to acquire the modified audio signal being adjusted in phase, the decoded audio signal using the vertical phase coherence of the control information, wherein the method is performed using a hardware apparatus or using a computer or using a combination of a hardware apparatus and a computer.

17. A method for encoding control information based on an audio input signal, comprising:

transforming the audio input signal from a time-domain to a spectral domain to acquire a transformed audio signal comprising a plurality of subband signals being assigned to a plurality of subbands, generating the control information indicating a vertical phase coherence of the transformed audio signal, and encoding the transformed audio signal and the control information to obtain encoded audio information that is decodable, wherein the method is performed using a hardware apparatus or using a computer or using a combination of a hardware apparatus and a computer.

18. A method for processing a first audio signal to acquire a second audio signal, comprising:

generating control information indicating a vertical phase coherence of the first audio signal, and modifying the first audio signal based on the control information to acquire the second audio signal, wherein modifying the first audio signal is conducted using the vertical phase coherence of the control information, wherein the method is performed using a hardware apparatus or using a computer or using a combination of a hardware apparatus and a computer.

19. A non-transitory computer-readable medium comprising a computer program for implementing the method according to claim 16 when being executed by a computer or signal processor.

20. A non-transitory computer-readable medium comprising a computer program for implementing the method according to claim 17 when being executed by a computer or signal processor.

21. A non-transitory computer-readable medium comprising a computer program for implementing the method according to claim 18 when being executed by a computer or signal processor.

22. An apparatus for audio decoding for decoding an encoded audio signal to acquire a modified audio signal, comprising:

a decoding unit; for decoding the encoded audio signal to acquire a decoded audio signal, and a phase adjustment unit, wherein the phase adjustment unit is configured to receive the decoded audio signal, wherein the phase adjustment unit is configured to receive control information indicating a vertical phase coherence of the encoded audio signal, and wherein, to acquire the modified audio signal being adjusted in phase, the phase adjustment unit is adapted to modify the decoded audio signal using the vertical phase coherence of the control information, wherein the audio decoder is implemented using a hardware apparatus or using a computer or using a combination of a hardware apparatus and a computer, wherein the control information depends on a combined envelope, wherein the combined envelope depends a subband envelope of each of the plurality of subband signals, and wherein the phase adjustment unit is configured to determine the subband envelope for each of a plurality of subbands of the decoded audio signal depending on the control information to acquire the modified audio signal.

23. An apparatus for audio encoding for encoding control information based on an audio input signal, comprising:

a transformation unit for transforming the audio input signal from a time-domain to a spectral domain to acquire a transformed audio signal comprising a plurality of subband signals being assigned to a plurality of subbands, a control information generator for generating the control information which indicates a vertical phase coherence of the transformed audio signal, and an encoding unit for encoding the transformed audio signal and the control information to obtain encoded audio information that is decodable, wherein the audio encoder is implemented using a hardware apparatus or using a computer or using a combination of a hardware apparatus and a computer, wherein the control information generator is configured to generate the control information depending on a combined envelope, wherein the combined envelope depends a subband envelope of each of the plurality of subband signals.

* * * * *